US010982357B2

(12) United States Patent
Seyam et al.

(10) Patent No.: US 10,982,357 B2
(45) Date of Patent: Apr. 20, 2021

(54) NON-STOP TYING-IN PROCESS

(71) Applicant: North Carolina State University, Raleigh, NC (US)

(72) Inventors: Abdel-Fattah M. Seyam, Raleigh, NC (US); William Oxenham, Raleigh, NC (US)

(73) Assignee: North Carolina State University, Raleigh, NC (US)

( * ) Notice: Subject to any disclaimer, the term of this patent is extended or adjusted under 35 U.S.C. 154(b) by 386 days.

(21) Appl. No.: 15/882,754

(22) Filed: Jan. 29, 2018

(65) Prior Publication Data

US 2018/0216263 A1 Aug. 2, 2018

Related U.S. Application Data

(60) Provisional application No. 62/451,851, filed on Jan. 30, 2017.

(51) Int. Cl.

| | |
|---|---|
| ***D03J 1/18*** | (2006.01) |
| ***D02H 5/00*** | (2006.01) |
| *D03D 41/00* | (2006.01) |

(52) U.S. Cl.

CPC ..... *D03J 1/18* (2013.01); *D02H 5/00* (2013.01); *D03D 41/008* (2013.01)

(58) Field of Classification Search

CPC ..... D03J 1/18; D03J 1/16; D03J 1/001; D03J 2700/00; D03D 49/20; D03D 41/008; D02H 5/00; D02H 3/00; D02H 7/00; D02H 11/00

USPC ..... 28/209–211, 208, 190, 193, 194, 195, 28/196, 201

See application file for complete search history.

(56) References Cited

U.S. PATENT DOCUMENTS 2,446,544 A * 8/1948 Brooks ..... D02H 3/00 28/211
2,479,604 A * 8/1949 Crandall ..... D03J 1/16 28/211
2,491,438 A * 12/1949 Bodansky ..... D02H 3/00 28/194

(Continued)

FOREIGN PATENT DOCUMENTS

DE 3636371 A1 * 4/1988 ..... D03J 1/18

OTHER PUBLICATIONS

English language machine translation of DE 3636371 (Doc pub. Apr. 1988), 8 pages.*

*Primary Examiner* — Amy Vanatta
(74) *Attorney, Agent, or Firm* — Thomas|Horstemeyer, LLP

(57) ABSTRACT

Various examples are provided for non-stop tying-in process for weaving of textiles. In one example, a method for non-stop tying-in of loom warps during operation of a loom includes providing free ends of a replacement warp sheet and a warp sheet tail to the tying-in machine during the operation of the loom, where the warp sheet tail is provided through a warp accumulator; accumulating the warp sheet tail in the warp accumulator during tying-in of the free ends; supplying at least a portion of the warp sheet tail accumulated by the warp accumulator to the loom after being released from a warp beam; removing the tied-in warp sheet tail and replacement warp sheet from the warp accumulator; and supplying the replacement warp sheet to the loom during its operation.

20 Claims, 17 Drawing Sheets

(56) References Cited

U.S. PATENT DOCUMENTS

| | | | | | | |
|---|---|---|---|---|---|---|
| 2,496,038 | A | * | 1/1950 | Crandall | D03J 1/18 | 28/211 |
| 2,585,708 | A | * | 2/1952 | Welch | D03J 1/16 | 156/158 |
| 2,717,117 | A | * | 9/1955 | Felton | D03J 1/16 | 28/211 |
| 2,856,671 | A | * | 10/1958 | Quinn | D02H 3/00 | 28/178 |
| 3,423,808 | A | * | 1/1969 | Altenweger | D02H 13/28 | 28/211 |
| 3,550,827 | A | * | 12/1970 | Timbie | D02H 13/00 | 226/25 |
| 3,583,619 | A | * | 6/1971 | Shepherd | B65H 59/34 | 226/113 |
| 4,321,736 | A | * | 3/1982 | Rohner | B65H 69/061 | 28/210 |
| 4,903,914 | A | * | 2/1990 | Seaborn | B65H 63/028 | 242/147 M |
| 5,588,194 | A | * | 12/1996 | Ulbrich | D02H 13/02 | 28/190 |

* cited by examiner 203
206
215
209

203
206
212
121
215
209

203
206
121
212
215
209

203
206
215
121
209

NON-STOP TYING-IN PROCESS

CROSS REFERENCE TO RELATED APPLICATIONS

This application claims priority to, and the benefit of, U.S. provisional application entitled "Non-Stop Tying-In Process" having Ser. No. 62/451,851, filed Jan. 30, 2017, which is hereby incorporated by reference in its entirety.

BACKGROUND

Over 50% of the world fiber production is converted to woven products including apparel, home, and technical textiles. The conversion of yarns to woven fabric requires several sequential processes. These are warping, sizing, drawing-in or tying-in, and weaving. The warping process converts wound packages to a warp beam on which a warp sheet of specified length and number of yarns is wound under uniform tension. One or more of the warp beams, with the total number of yarns required in the final woven fabric, are then moved to the sizing process, which is required if the yarn is single spun yarn or flat continuous filament yarn. In the sizing process, the warp yarn is prepared for the rigor of the weaving process where the yarns are subjected to complex field of stresses (tension, abrasion, bending and impact). Here the yarn is treated by a size solution that contains ingredients (e.g., water, size agent as film former, adhesive, and lubricant) to encapsulate the yarn with film former material (e.g., natural starch or synthetic material). This allows the hairiness to be integrated into the yarn body in case of spun yarn or integrate the filaments into one consolidated structure to prevent the vulnerable individual filament from breaking in flat yarn. Without sizing of such yarns, breaks and defects during weaving occur that lead to extremely low weaving efficiency and inferior fabric quality.

The next process is either tying-in or drawing-in. The tying-in is performed if the same fabric is being continued and the warp beam on the loom runs out. The tying-in process is conducted behind the weaving machine by using an automatic tying-in machine. During the tying-in process, each warp yarn from a full warp beam is knotted to its corresponding yarn from the run out warp beam. The process requires series of steps by a skilled operator to prepare the two sheets (one from the run out beam and the other from the full beam) before tying-in and set them in the tying-in machine for automatic knotting and ensure the knots will pass through different loom parts after the completion of knotting. A recent time study showed that the entire process takes about three hours for medium warp density during which the weaving process is stopped.

While modern weaving machines operate at faster speeds than before, the weaving process remains the slowest process in the entire production pipeline. Because the weaving process is the bottleneck in the production pipeline, high-speed machine manufacturers have developed better and more powerful motors, lighter/stronger machine parts, and separate drives of weaving motions. These weaving machines can run faster if the warp and weft yarns can handle the complex stresses (e.g., tension, bending, abrasion, and impact) that arise from the high speed combined with the nature of the process. This is due to the nature of the weaving process and the inherent properties of the warp and weft yarns. Research and development has led to better prepared yarns that can withstand the rigor of weaving process and minimize yarn breaks during weaving and hence increase weaving efficiency. However, with finite tensile strength and abrasion resistance, the yarns still break during weaving. As a result, the process will be automatically stopped to repair the broken yarns. The process will also be stopped for style change, which is conducted when warp beam runs out and new fabric with different specifications is required, and tying-in, which is performed when the warp beam run out and the same fabric to be continued. Such stoppages severely impact the process efficiency.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1A:
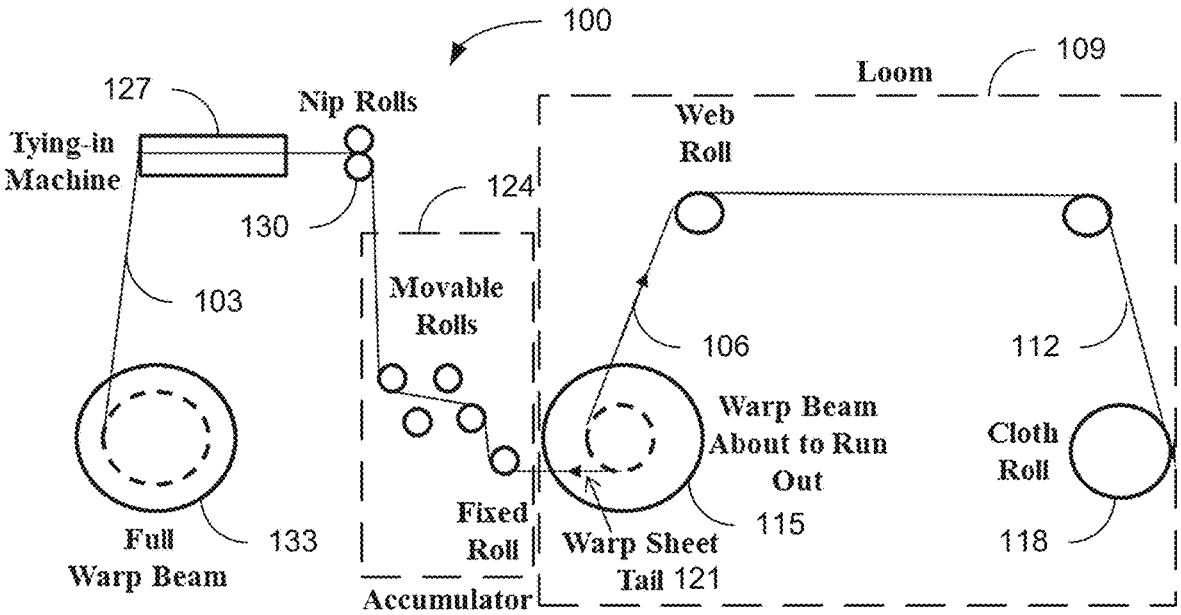
FIGS. 1A and 1B are schematic diagrams illustrating an example of a non-stop tying-in system using a warp accumulator, in accordance with various embodiments of the present disclosure.

Disclosed herein are various embodiments of methods related to non-stop tying-in process for weaving of textiles. Reference will now be made in detail to the description of the embodiments as illustrated in the drawings, wherein like reference numbers indicate like parts throughout the several views.

A finite length of warp sheet is supplied on a warp beam behind the loom that will eventually run out and this requires stopping the process to replace run out beam with a full beam. When the warp beam runs out, the operator stops the weaving process, and an automatic tying-in machine is brought to the loom along with a full warp beam. Setting time, which is conducted by the operator, is required before the automatic tying of each warp yarn from the run out beam to its corresponding yarn of the full beam. Style change generally takes 4-8 hours to complete, while tying-in needs about 3 hours for 1.5 meter wide warp with medium warp thread density and longer time for a high warp density, which significantly reduces the efficiency for high-speed weaving.

In order to provide new warp supply, the weaving machine is stopped, and an automatic tying-in machine is brought to the loom along with a full warp beam, to allow for knotting of yarns from the new warp beam to the end of the outgoing yarns. This essentially renders weaving as a batch process. This disclosure presents methods, systems and apparatus that eliminate the need for stopping the weaving process in order to conduct tying-in. By implementing a non-stop tying-in process, the loom is allowed to run without stopping, increasing weaving efficiency and productivity of the loom. The disclosed approach utilizes a warp accumulator that ensures that the tension and feed of the warp yarn to the loom are maintained at values within specified range (upper and lower limits) while tying-in process and its associated preparation are being conducted. The system can create a reservoir of warp yarn sheet which is sufficiently long to enable the loom to continue running while the tying-in process is being undertaken.

Figure 1B:
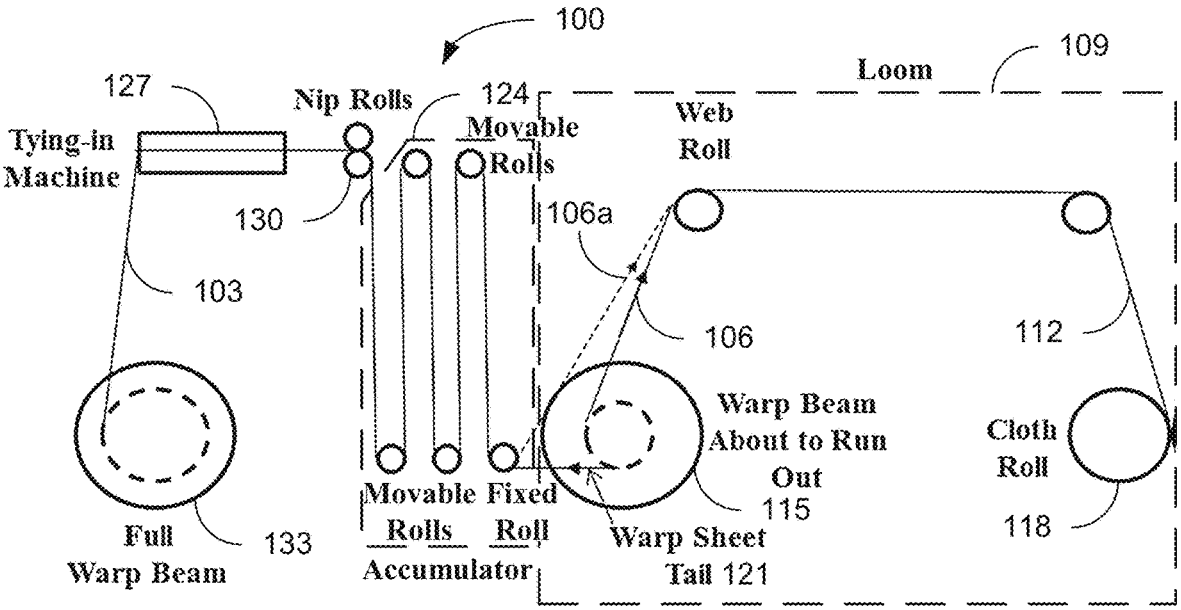

Referring to FIGS. 1A and 1B, shown are schematic diagrams illustrating an embodiment of a system 100 of that can be used for tying-in yarns of a new warp sheet 103 into yarns of an existing warp sheet 106 without interrupting operation of a loom 109 as it weaves a cloth or fabric 112 from the warp yarns of the existing sheet 106. The loom 109 receives the yarns as they are unwound (or let-off) from a warp beam 115, and weaves them into a cloth or fabric 112, which is collected on the cloth roll 118. The weaving width can range from about one inch to about 8 meters, or even wider. The existing warp sheet 106 includes a warp sheet tail (or warp tail) 121 that was provided during its winding on the loom warp beam 115. The warp sheet tail 121 can be achieved at the warping or sizing stage as a loom warp beam is formed by creating a loop of yarn at the start of the wind of the warp beam 115, as will be described. As the existing warp sheet 106 begins to reach its end on the warp beam 115, the warp sheet tail 121 emerges from the warp beam 115. As the existing warp sheet 106 runs out, the warp tail 121 is available for connection to a new warp sheet 103.

As the warp sheet tail 121 is unspooled, it can be threaded or laced through rollers of a warp accumulator 124 as shown in FIG. 1A. The warp accumulator 124 can include a combination of movable and fixed rollers that allow the excess warp sheet tail 121 to be accumulated as it is released from the warp beam 115. The free end of the warp sheet tail 121 can then be supplied to a tying-in machine 127 for connection with the new warp sheet 103. The free end of the warp tail 121 can pass through nip rolls 130, which could be part of the accumulator to secure the end of the warp sheet tail 121 in position, before it is secured to the tying-in machine 127. The new warp sheet 103 is also supplied to the tying-in machine 127 from a full replacement warp beam 133. As the tying-in process proceeds, the rollers of the warp accumulator 124 can move apart to gather up the extra warp sheet tail 121 as it is discharged from the warp beam 115 as illustrated in FIG. 1B. Control of the warp accumulator 124 allows the tension of the warp tail 121 to be maintained at a desired level during the tying-in of the warp sheet tail 121 with the new warp sheet 103. During this time, the loom 109 also continues to run.

Figure 2A:
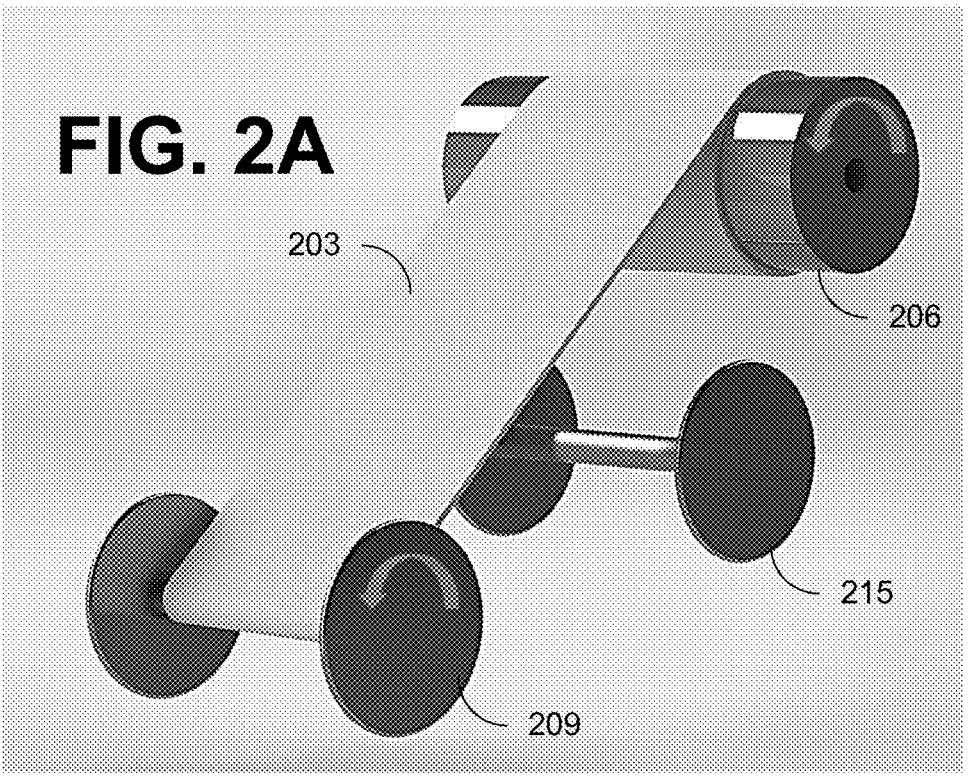
FIGS. 2A through 2D are graphical representations illustrating an example of winding a warp beam with a warp sheet tail, in accordance with various embodiments of the present disclosure.

Referring now to FIGS. 2A-2D, shown are graphical representations illustrating the winding procedure for providing the warp sheet tail 121 on a warp beam such as, e.g., the warp beam 115 or the replacement warp beam 133 illustrated in FIGS. 1A and 1B. Initially, a new warp sheet 203 is formed on a pattern drum 206 of an indirect warping machine (or a beamer of a sizing machine post sizing in case of direct warping). A desired length of the warp sheet 203 can then be wound on a tail beam 209 from the pattern drum 206 to form the warp sheet tail 121 as shown in FIG. 2A. The length of the warp sheet tail 121 can be determined based upon, e.g., the weaving speed of the loom, weft density (picks/unit fabric length), the time needed to set up the warp accumulator 124 and tying-in machine 127, tie-in the new warp sheet, and remove the warp accumulator 124, and/or the capacity of the warp accumulator 124.

Figure 2B:
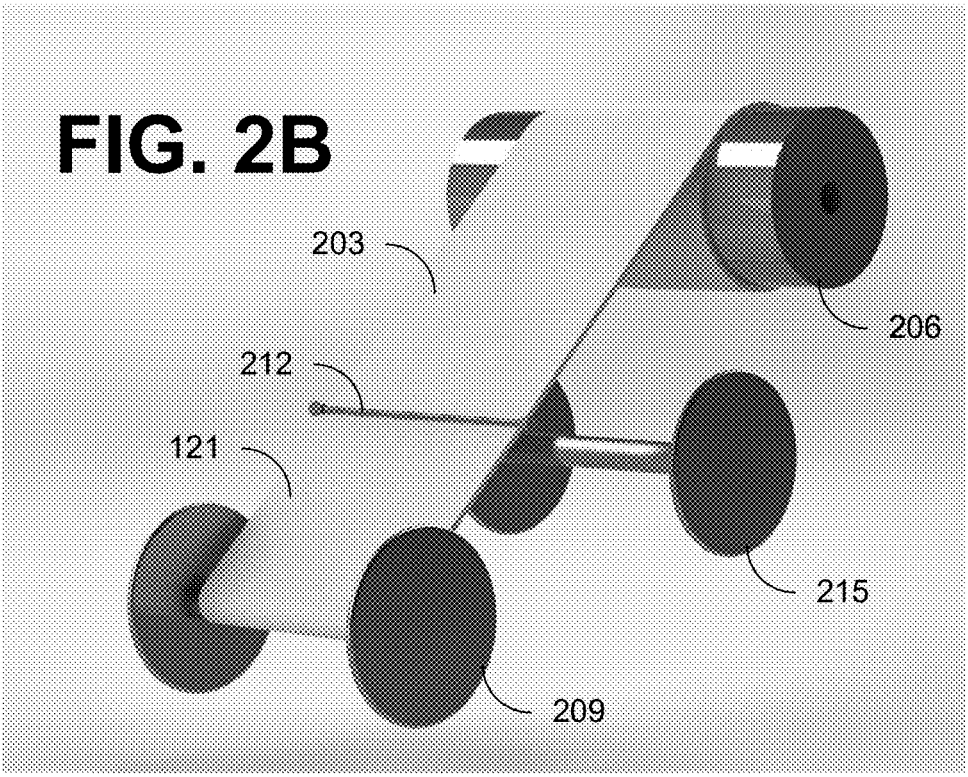
Figure 2C:
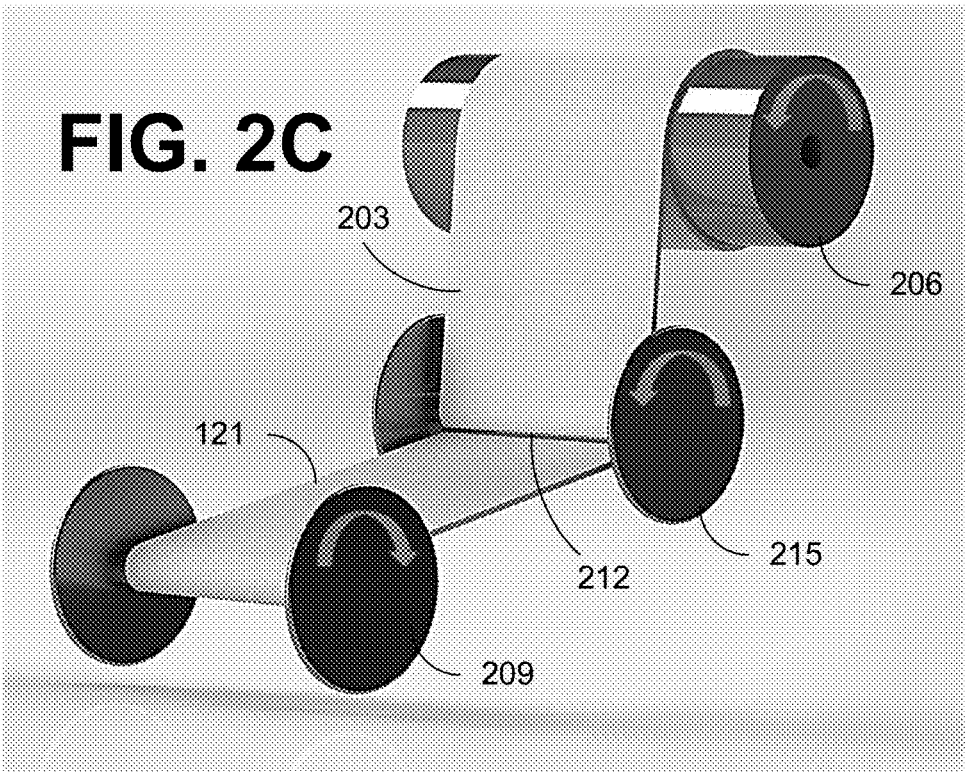
Figure 2D:
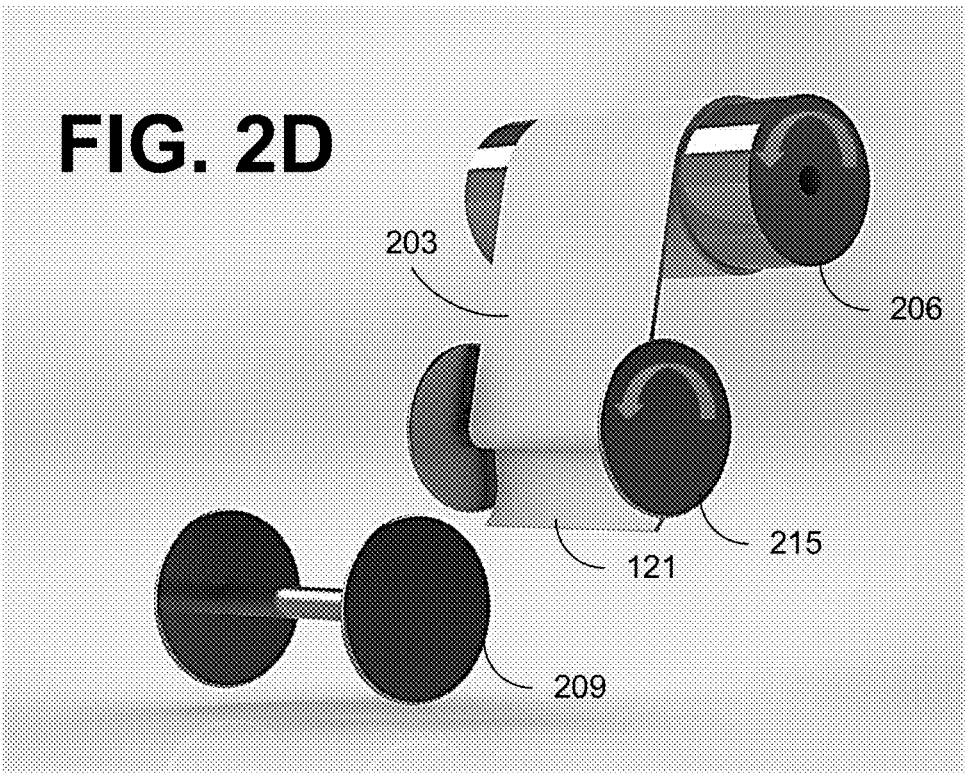

As shown in FIG. 2B, a spring rod 212 can be used to separate the warp sheet tail 121 from the rest of the warp sheet 203. The spring rod 212 can be placed at the end of the warp sheet tail 121 and secured in place on a warp beam 215 (e.g., warp beams 115 and 133 in FIGS. 1A and 1B) as illustrated in FIG. 2C. The spring rod 212 allows the warp sheet tail 121 to be folded over the warp sheet 203 as it is wound on the warp beam 215 from the pattern drum 206 and tail beam 209. Other removable mechanism such as, e.g., a blade, plate or screw can be utilized to secure the warp sheet in position. As shown in FIG. 2D, a double layer is wound on the warp beam 215 until the end of the warp tail 121 is reached, after which a single layer of the remaining warp sheet 203 is wound on the warp beam 215. The free end of the warp sheet 203 will then be available for tying-in with the warp sheet tail 121 of an existing warp sheet 106 as shown in FIGS. 1A and 1B, or for setting up a loom 109 (FIG. 1).

As the warp sheet 203 (or 106 of FIG. 1B) and warp sheet tail 121 unwind from the warp beam 215, the spring rod 212 can pull free from the warp beam 215 to release the warp sheet 203. This is graphically illustrated by the dashed line 106*a* in FIG. 1B. As the warp sheet 106 and warp tail 121 are released from the warp beam 115, the rollers of the warp accumulator 124 can be adjusted to gather up the slack and maintain tension of the warp sheet 106 being fed into the loom 109. In some implementations, the warp sheet 106 can pass through nip rollers located at the inlet of the loom 109 to maintain tension and position of the yarns. The warp sheet 106 and warp sheet tail 121 can then continue to feed the loom 109 without interruption of the weaving process or the tying-in process. As the warp sheet tail 121 of the warp sheet 106 is supplied to the loom 109, the rollers of the warp accumulator 124 can move together to release the extra warp sheet tail 121. When the tying-in process has been completed, the tying-in machine 127 can be removed. In addition, the empty warp beam 115 can be replaced by the full warp beam 133 and the warp accumulator 124 can be removed to allow the new warp sheet 103 to be supplied to the loom 109 without interruption. The warp accumulator 124 can be a splittable assembly configured to split apart to allow it to be separated from the warp sheet 103. In other embodiments, some or all of the rollers can be removable from the frame of the warp accumulator 124 to allow it to be separated from the warp sheet 103.

Figure 3A:
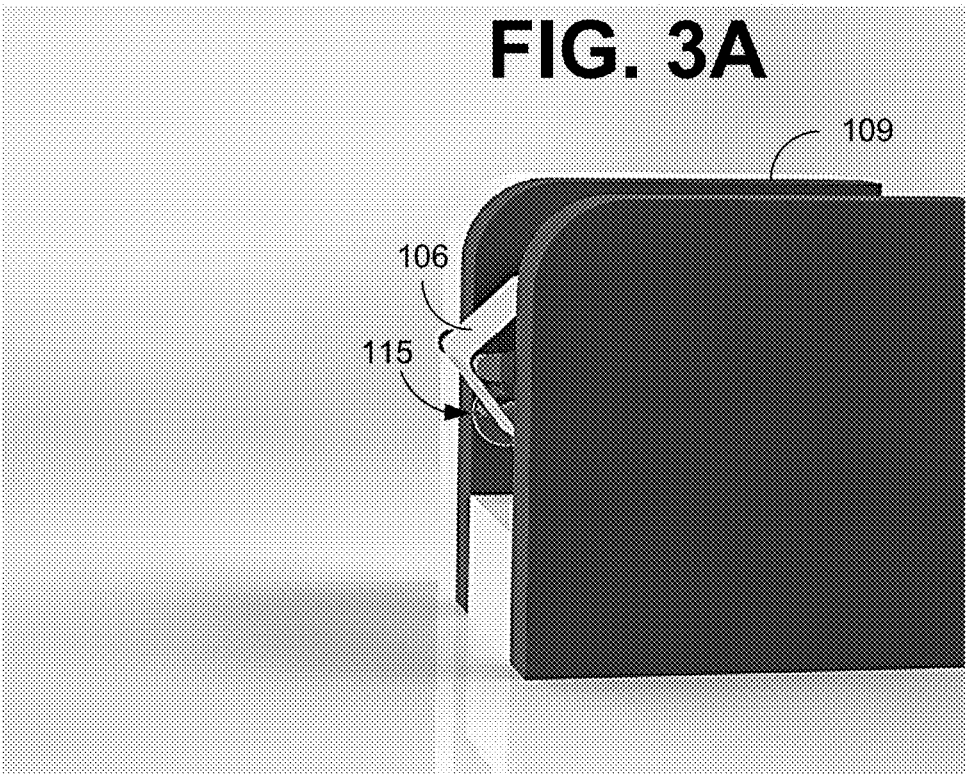
FIGS. 3A through 3J graphically illustrate an example of a non-stop tying-in process using an example of the warp accumulator of FIGS. 1A and 1B, in accordance with various embodiments of the present disclosure.
Figure 3B:
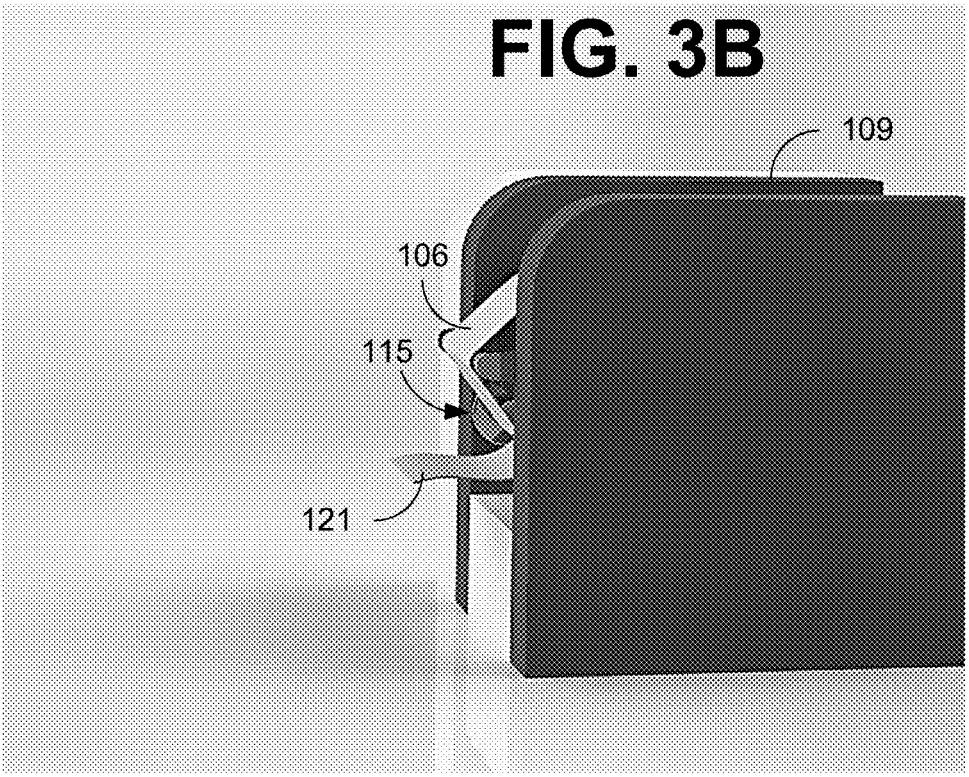
Figure 3C:
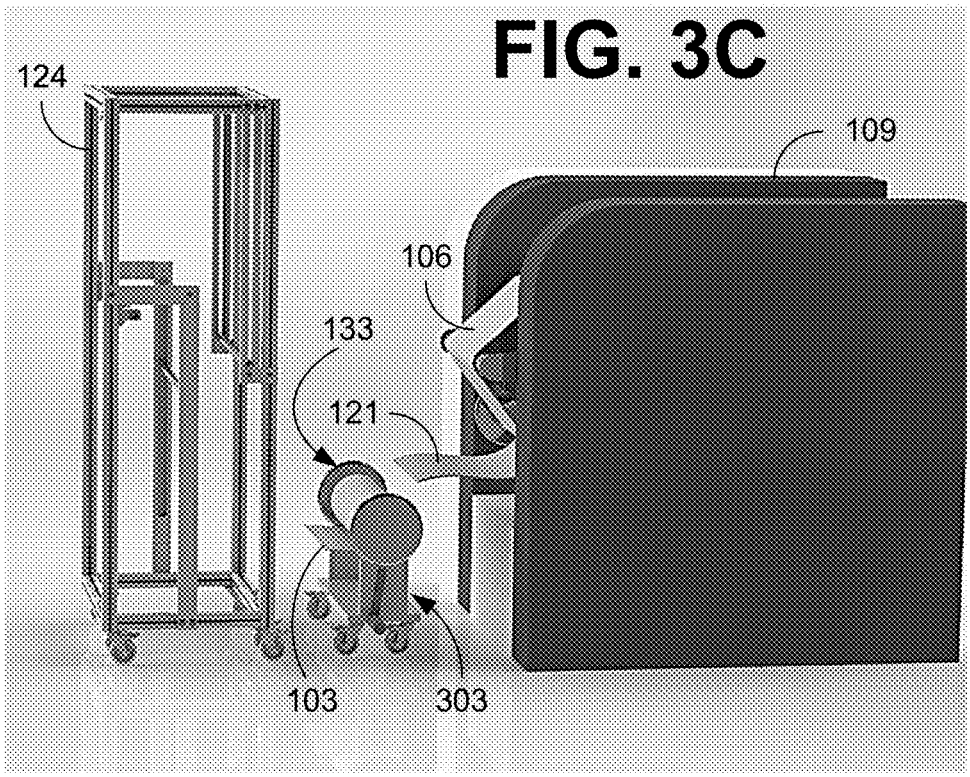
Figure 3D:
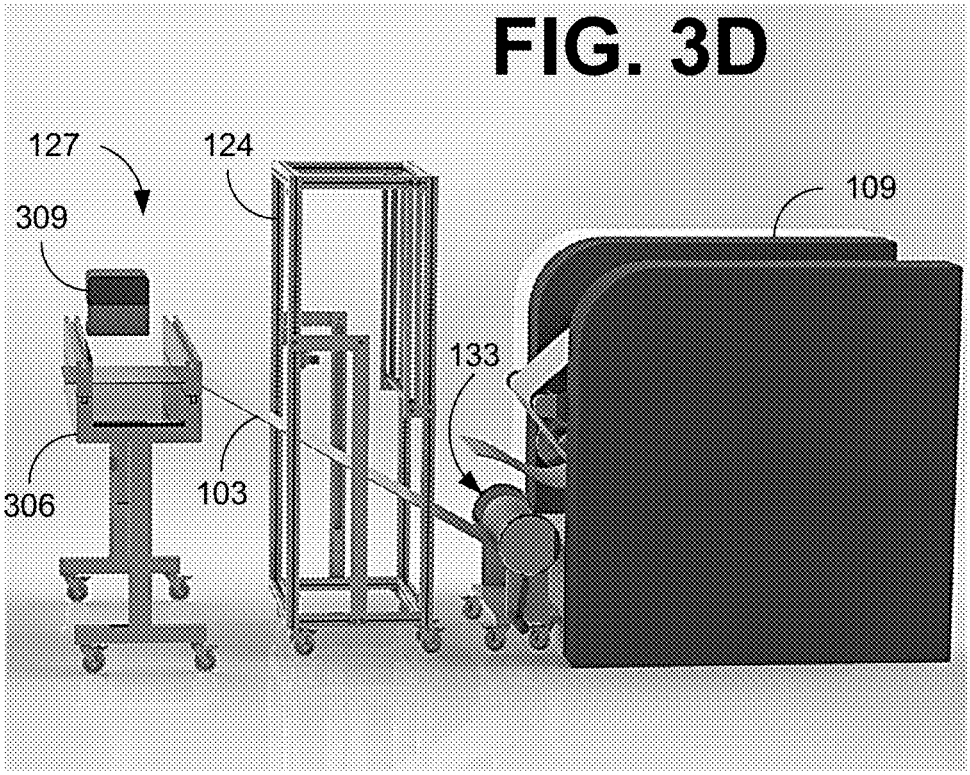

FIGS. 3A-3J further illustrate an example of non-stop tying in process that has been described. In FIG. 3A, a warp sheet 106 is being supplied to a loom 109 from an installed warp beam 115. As the warp sheet 106 is let-off from the warp beam 115, the free end of the warp sheet tail 121 is released from the warp beam 115 and becomes exposed as shown in FIG. 3B. As shown in FIG. 3C, a replacement warp beam 133 with a new warp sheet 103 and a warp accumulator 124 can be positioned adjacent to the loom 109 in preparation for the tying-in of the new warp sheet 103. The replacement warp beam 133 can be provided on a portable support system 303 to facilitate movement and positioning of the full warp beam 133 adjacent to the loom 109. The warp accumulator 124 can be a portable structure that allows it to be positioned next to the replacement warp beam 133, on the side opposite to the loom 109. In addition, the tying-in machine 127 can be positioned next to the warp accumulator 124, on the side opposite the replacement warp beam 133, as illustrated in FIG. 3D. The tying-in machine 127 includes a tying-in table 306, to which yarns of the warp sheets 103 and 106 are secured, and a tying-in head 309 that ties the corresponding yarns together.

Figure 3E:
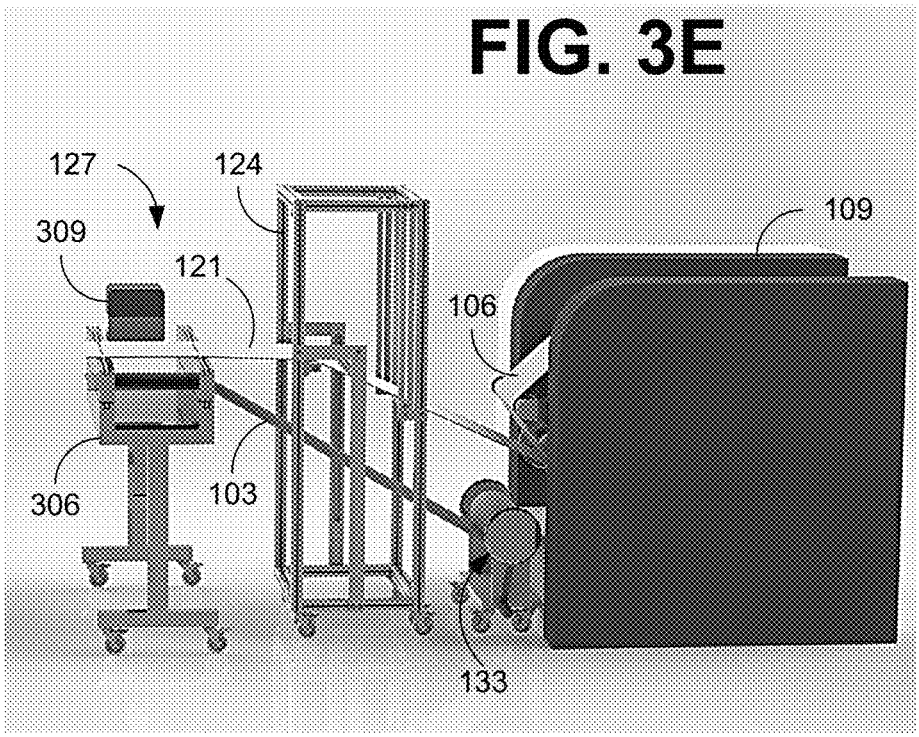
Figure 3F:
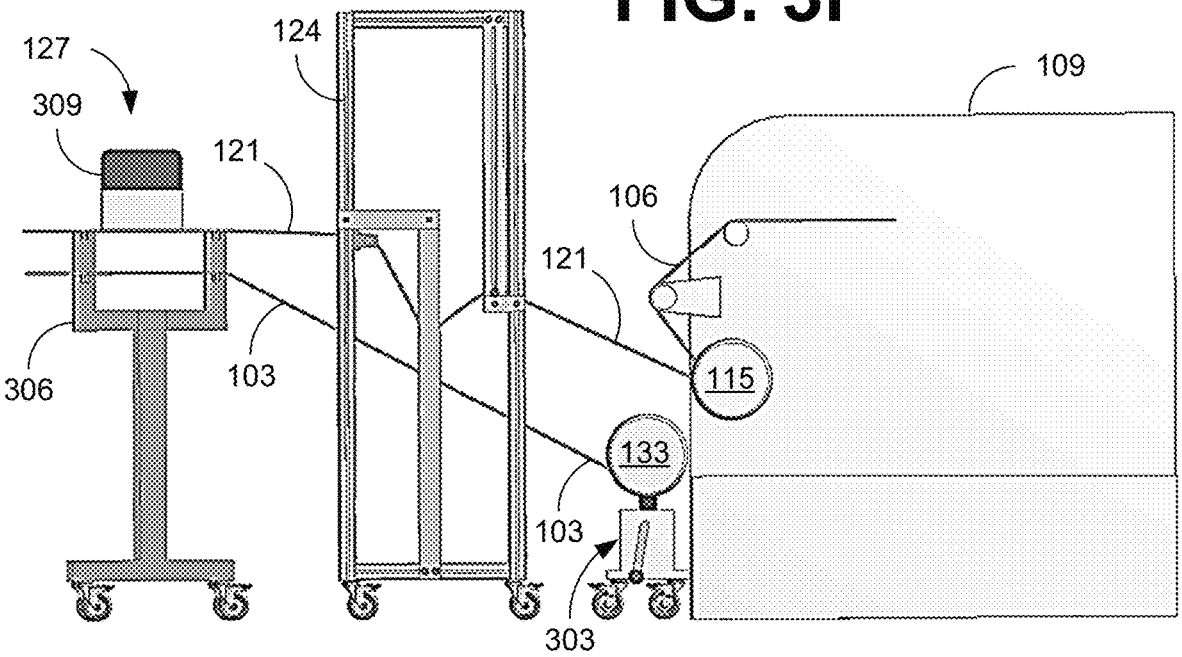

The free end of the new warp sheet 103 can be fed through the warp accumulator 124 and fixed to the tying-in table 306 as shown in FIG. 3D. As the warp sheet tail 121 is released from the warp beam 115 in the loom 109, the free end can be threaded through the rollers of the warp accumulator 124 and fixed to the tying-in table 306 as shown in FIG. 3E. The tying-in head 309 can then connect the yarns of the new warp sheet 103 to the corresponding ones of the warp sheet tail 121. As the warp tail 121 is released from the warp beam 115 during the tying-in of the yarns, the rollers of the warp accumulator 124 are moved to absorb the excess warp tail 121 as shown in the cutaway view of FIG. 3F.

Figure 3G:
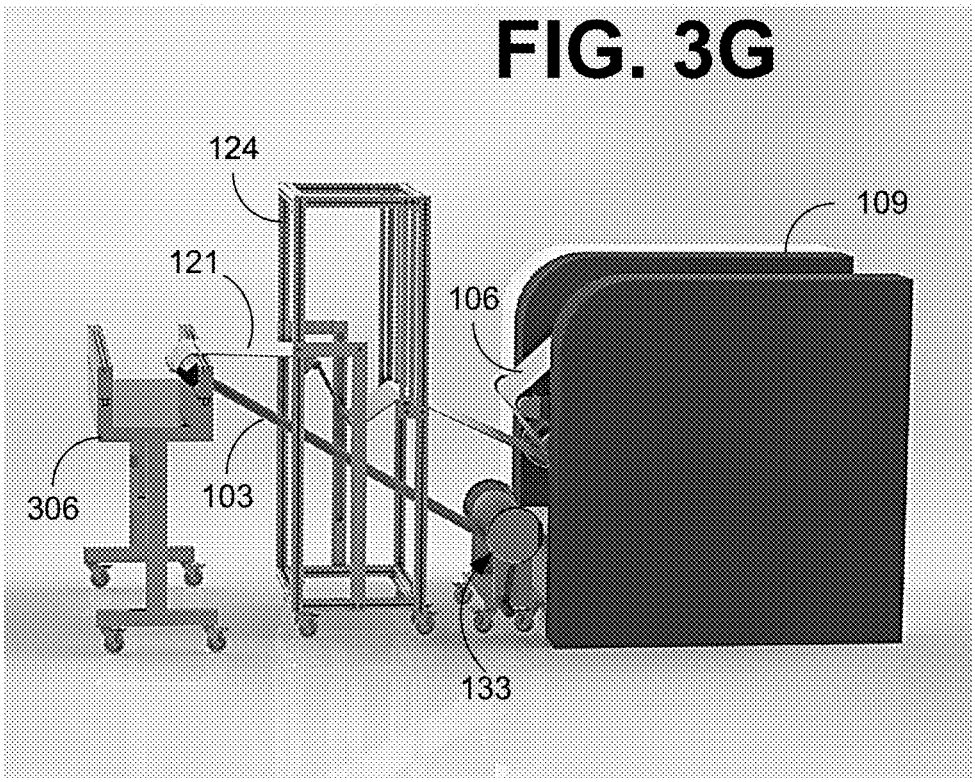
Figure 3H:
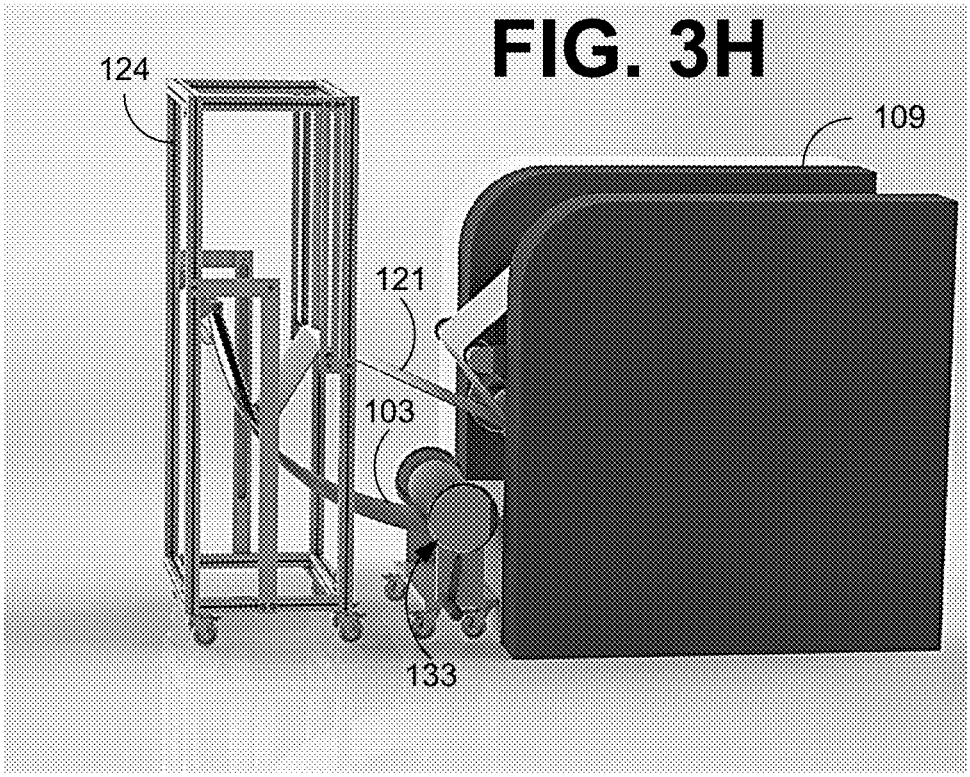
Figure 3I:
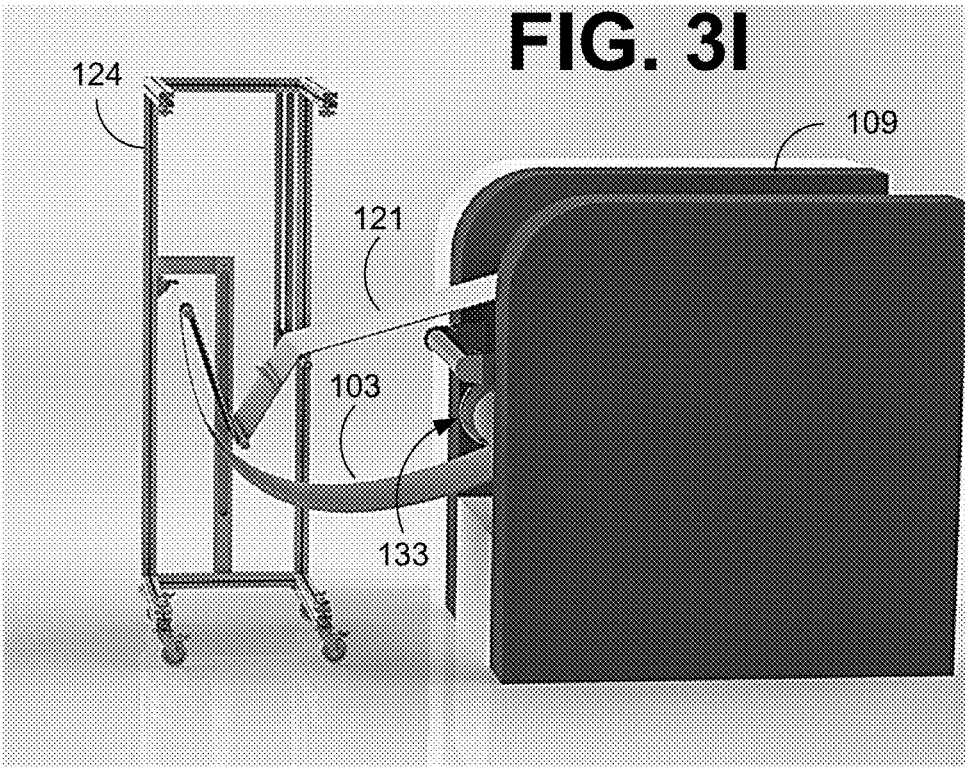
Figure 3J:
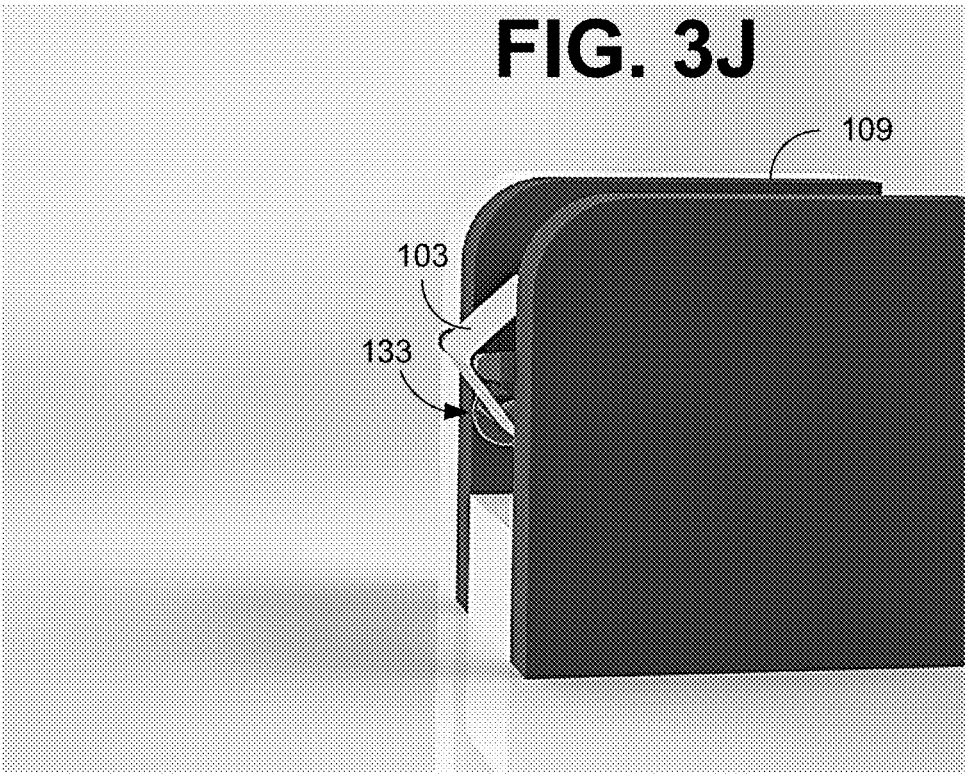

After the connection knots have been tied, trimmed and brushed as shown in FIG. 3G, the new warp sheet 103 and warp sheet tail 121 can be released from the tying-in table 306 and the excess warp material can be accumulated and stored on the rollers of the warp accumulator 124 as shown in FIG. 3H. The warp accumulator 124 continues to gather up the excess warp sheet tail 121 until it is released from the warp beam 115. At that point, the empty warp beam 115 can be replaced by the new warp beam 133 as the warp accumulator 124 releases the stored warp tail 121 to the loom 109. The warp accumulator 124 can then be removed to allow the warp sheet tail 121 and the new warp sheet 103 to feed the loom 109 without stopping the weaving process. As shown in FIG. 3I, the warp accumulator 124 can be split to allow the rollers to disengage from the warp sheet tail 121 and/or new warp sheet 103, and the warp accumulator 124 can be moved and reassembled for the next tying-in operation. In other embodiments, at least a portion of the rollers can be removed to disengage the warp sheet tail 121 and/or new warp sheet 103 from the warp accumulator 124. For example, one or more rollers can be disengaged and removed from the frame of the warp accumulator 124. In some implementations, a roller can horizontally slide out of the warp accumulator 124 to free the warp sheet tail 121 and/or new warp sheet 103. In other implementations, a roller can swing out of the way to release the warp sheet tail 121 and/or new warp sheet 103. As the warp tail 121 is used up, the new warp sheet 103 is supplied to the loom 109 from the installed warp beam 133 without stopping as was illustrated in FIG. 3J.

Figure 4A:
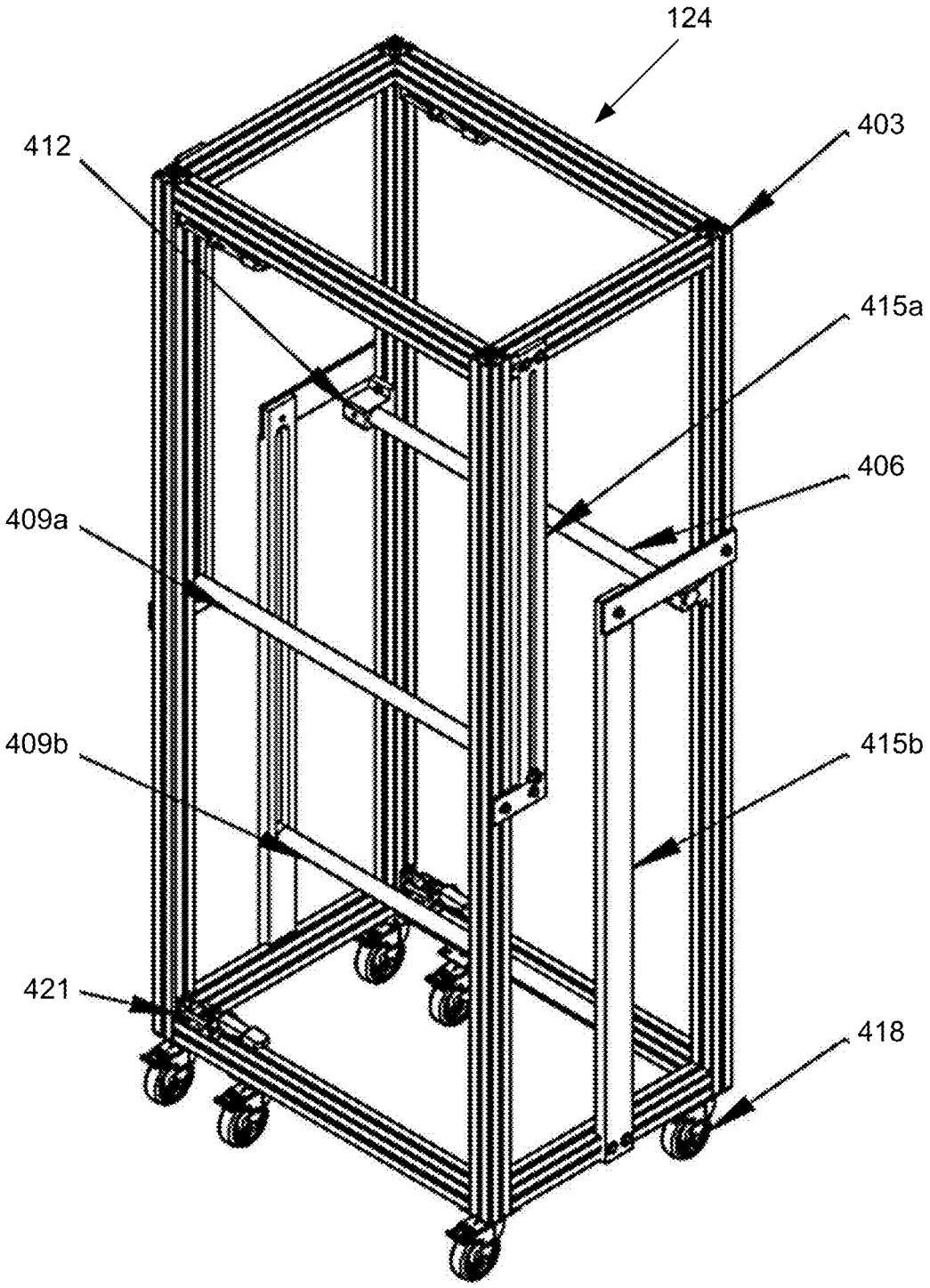
FIGS. 4A through 4D are schematic diagrams illustrating an example of the warp accumulator of FIGS. 1A and 1B, in accordance with various embodiments of the present disclosure.
Figure 4B:
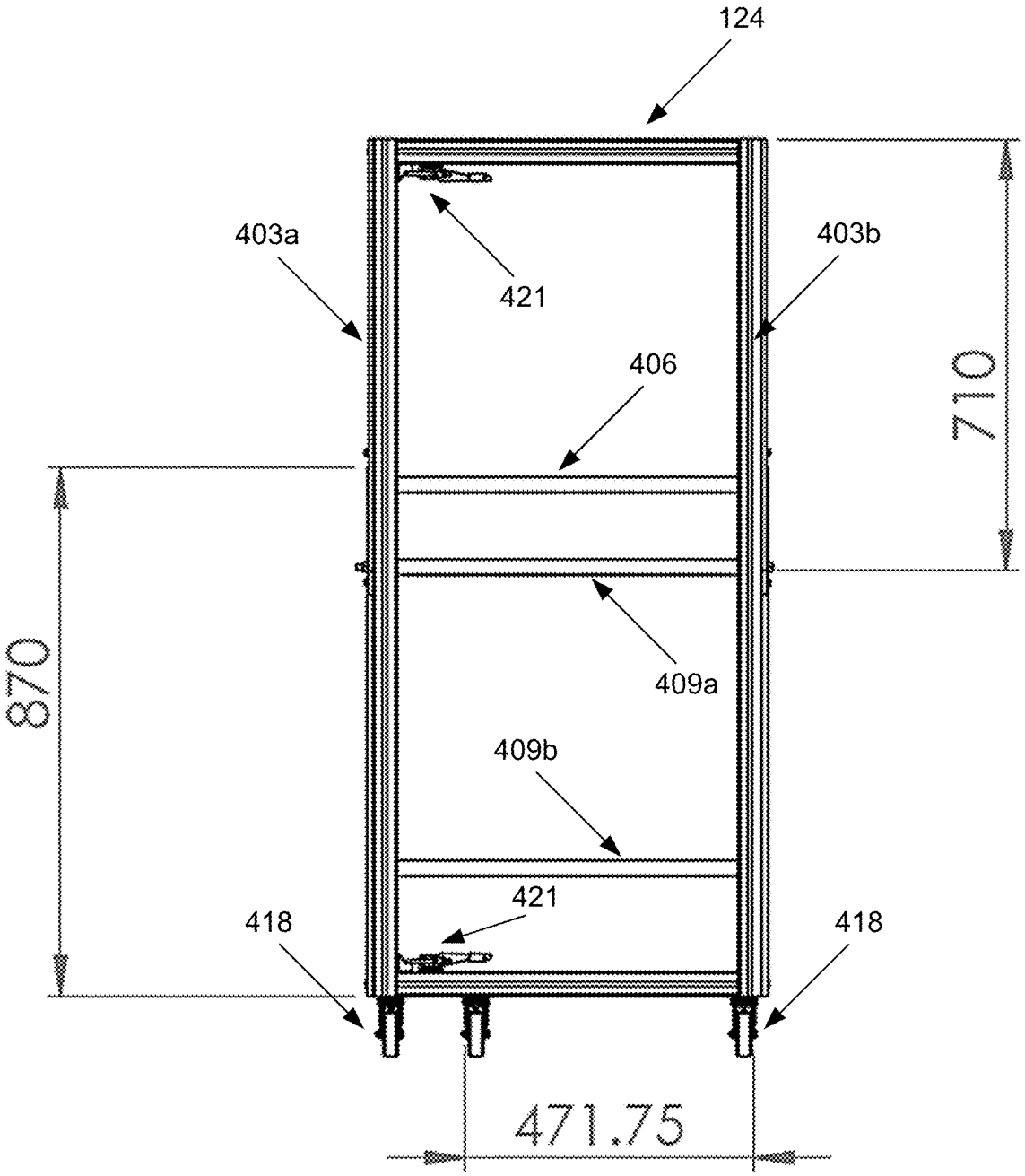
Figure 4C:
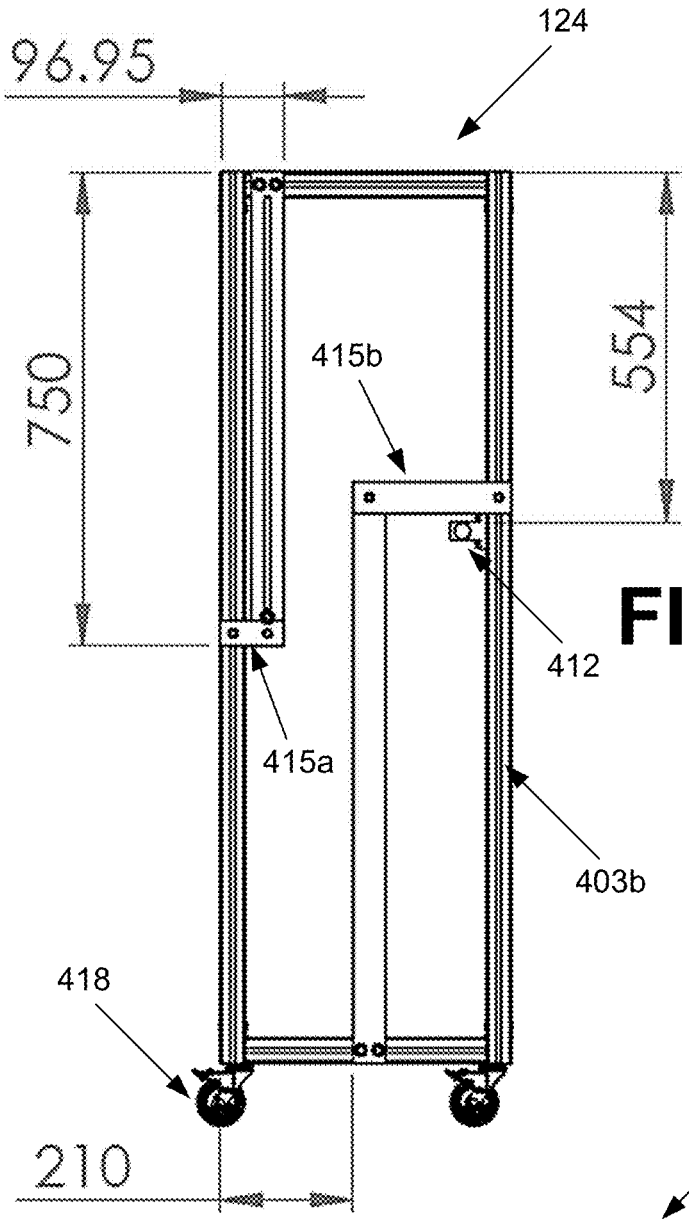
Figure 4D:
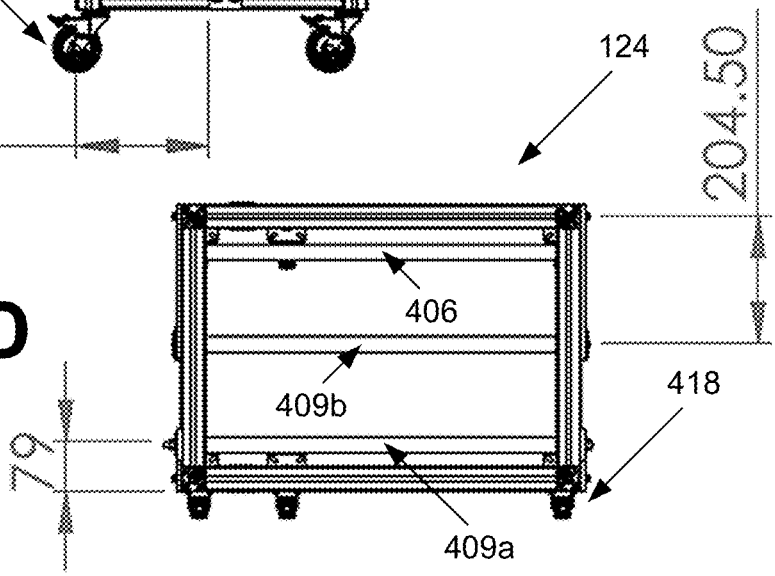

Referring next to FIGS. 4A-4D, shown are graphical representations of an example of a warp accumulator 124. FIGS. 4A, 4B and 4C are perspective, front and side views of a warp accumulator 124 including a frame 403 that supports a combination of one or more fixed roller 406 and movable rollers 409 that are configured to move to accumulate warp material as it is discharged from a warp beam. The fixed rollers 406 can be held in position by, e.g., a pillow bearing 412 or other appropriate fixing assembly secured to the frame 403. The movable rollers 409 can include rollers (e.g., 409*a* and 409*b*) that are adjustable, floating or a combination thereof. The frame 403 includes movable roller guide brackets 415 to maintain the relative positions of the movable rollers 409 during movement. FIG. 4D shows a top view of the warp accumulator 124. The indicated dimensions are examples provided in mm, which fits an accumulator of narrow weaving machines.

In the example of FIGS. 4A-4D, the guide brackets 415 are mounted vertically in the frame 403. The movable rollers 409*a* and 409*b* can be adjusted to allow for controlled accumulation of the warp sheet tail 121 (FIGS. 1A and 1B). Control can be active or passive, or some combination thereof. In some implementations, some of the movable rollers (e.g., 409*b*) can be configured to float within the corresponding guide brackets 415 to allow the warp accumulator 124 to automatically react to any changes in the warp material. The position of the movable roller(s) 409 is decided based on the tension level of the warp tail 121, which should be the same as the tension of the warp sheet 106 being woven since the warp tension is an important parameter in determining the woven fabric attributes that need to be kept the same throughout the weaving process. Knowledge of warp tension can be obtained by measuring its level from the warp sheet 106 being woven and this level can be used as input parameter to the accumulator controller.

In some implementations, a sensing roller, which is part of the warp accumulator 124, can be used to continuously monitor the warp sheet tension and provide feedback to a motor or other appropriate actuator (e.g., linear motor, hydraulic or pneumatic actuator, etc.) that controls the movable roller(s) of the warp accumulator 124 via a computerized controller. For example, after the warp sheet tail 121 has been threaded through the rollers 406 and 409, the movable roller(s) 409*a* can be moved upward in the guide brackets 415*a* as the warp tail 121 unwinds from the warp beam 115 (FIGS. 3E and 3G). The movable roller(s) 409*b* can be held in a fixed position or moved downward in the guide brackets 415*b* to adjust for changes in the discharge rate of the warp sheet tail 121. For example, when the warp tail 121 and remaining warp sheet 106 is freed from the warp beam 115 as in FIG. 3I, the movable roller(s) 409*b* can move within the guide bracket 415*b* to absorb the extra material and adjust as the loom 109 starts to take up the warp sheet tail 121. The movement of the movable roller(s) 409 can be selected to maintain the desired tension on the warp material.

The frame 403 includes wheel castors 418 distributed about the bottom surface to facilitate movement and positioning of the warp accumulator 124. Other forms of moveable support can also be used. For instance, air cushions can be used to allow the warp accumulator 124 to be supported and moved as needed. The frame 403 is also configured to allow one side 403*a* of the frame to be disconnected and removed from the remaining portion 403*b* so that the warp accumulator 124 can be removed from the loop formed when the free end of the warp sheet tail 121 is tied-in with the end of the new warp sheet 103, as illustrated in FIGS. 3G and 3H. As shown in FIG. 3I, one side of the warp accumulator 124 can be removed to release the combined warp sheet from the warp accumulator 124. As shown in FIGS. 4A and 4B, the two portions of the connected using, e.g., quick release latch clamps 421. In the embodiment of FIGS. 4A-4D, the removable section or side includes two wheel castors 418 and the remaining portion of the warp accumulator 124 includes four wheel castors 418 to provide stability when the removable section or side is removed as shown in FIG. 3I. In other embodiments, the rollers can be removable to release the combined warp sheet from the warp accumulator 124.

The frame 403 can be fabricated from an extruded metal (e.g., T-slotted extruded aluminum tubing) or other appropriate material. In some implementations, the fixed roller(s) 406 can comprise metal rollers with plastic end caps that are held in position by, e.g., pillow bearings 412 mounted to the frame 403. In alternative implementations, the rollers 406 can comprise the bearings (and bearing covers). The movable roller(s) 409 can comprise metal rollers with ball bearings mounted on threaded plastic end pieces. The movable roller(s) 409 are confined in grooves or slots that extend vertically in guide brackets 415 that are mounted to the frame 403. In some implementations, the guide brackets 415 can be mounted horizontally, allowing the moveable rollers 409 to move horizontally during accumulation of the warp sheet tail 121. In that case, two sets of movable rollers 409*a* may be used to accumulate the warp sheet tail 121. In other embodiments, the movable roller(s) 409 can comprise metal rollers with plastic end caps that are confined in grooves or slots that extend vertically in movable roller guide brackets 415 that are mounted to the frame 403. This can allow the movable roller 409 to float within the guide brackets 415.

While the warp accumulator 124 depicted in FIGS. 4A-4D comprises rollers 406 and 409 extending between two sides of the frame 403, other embodiments of the warp accumulator 124 can include rollers 406 and 409 that are supported by the frame 403 on only one end, in a cantilever fashion, or the rollers may be moveable horizontally so they can be moved from the path of the warp sheet. In such cases, the open end design allows the warp sheet tail 121 to be easily threaded through the rollers 406 and 409 of the warp accumulator 124 and the new warp sheet 103 and warp sheet tail 121 to be easily removed from the warp accumulator 124 after tying-in, without the need to split the warp accumulator 124. In other embodiments, the warp accumulator 124 can be configured to allow one or more rollers 406 and/or 409 to slide horizontally out of the assembly and/or swing about one end to release the new warp sheet 103 and/or warp sheet tail 121. For example, a roller can be supported at one end that allows it to pivot in a cantilever fashion to free the warp sheet.

Figure 5A:
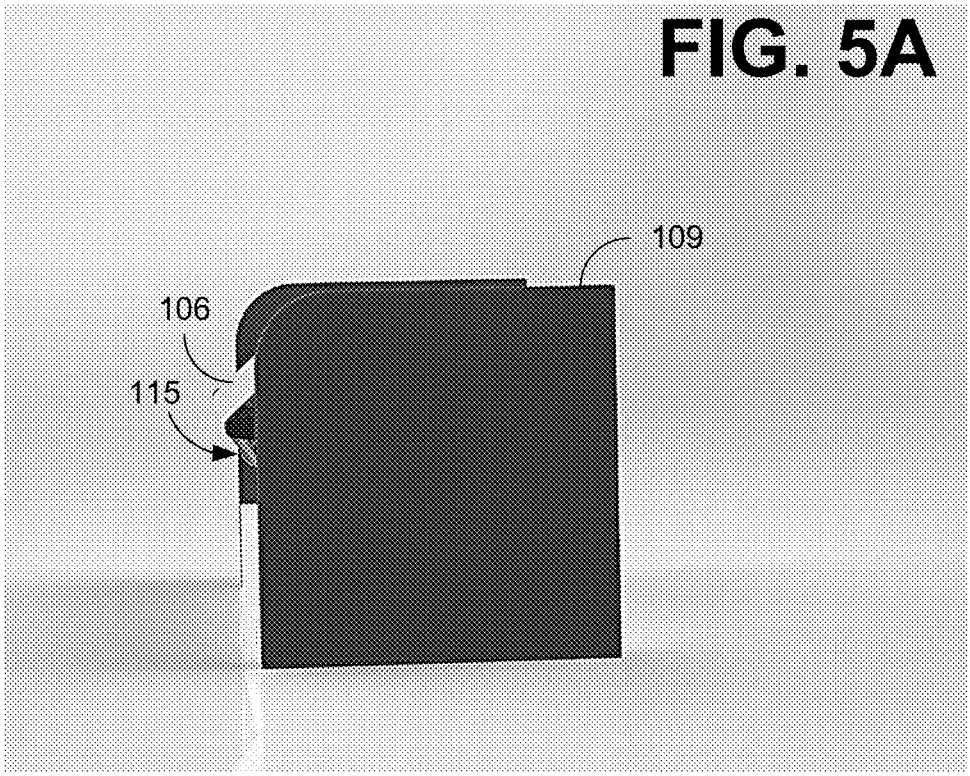
FIGS. 5A through 5K graphically illustrate an example of a non-stop tying-in process using another example of the warp accumulator of FIGS. 1A and 1B, in accordance with various embodiments of the present disclosure.
Figure 5B:
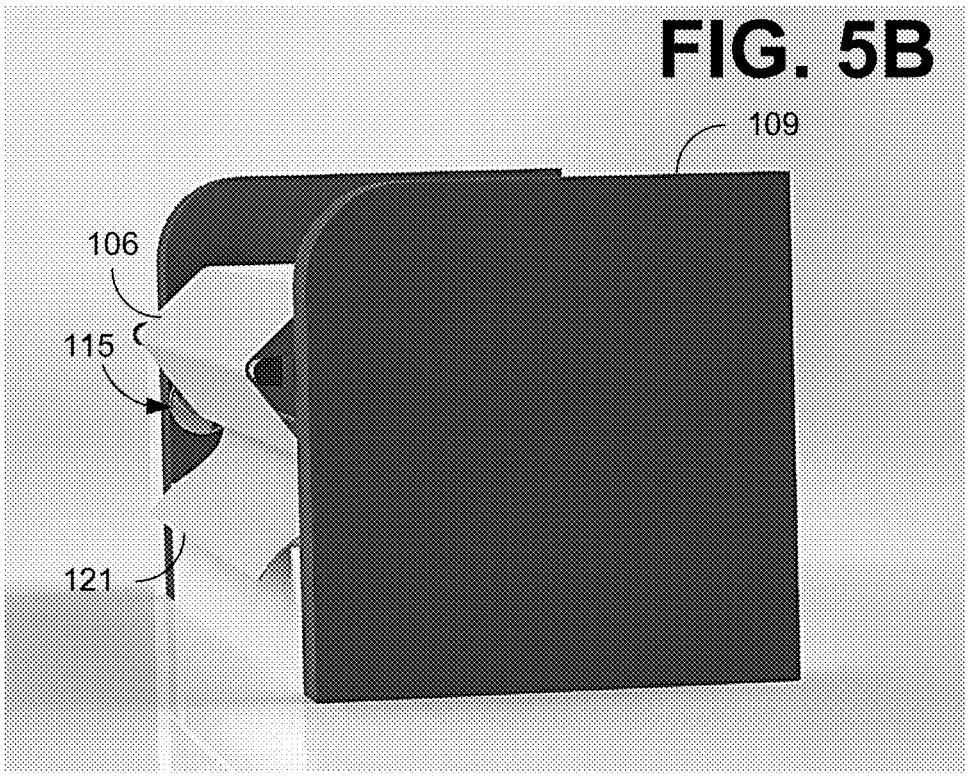
Figure 5C:
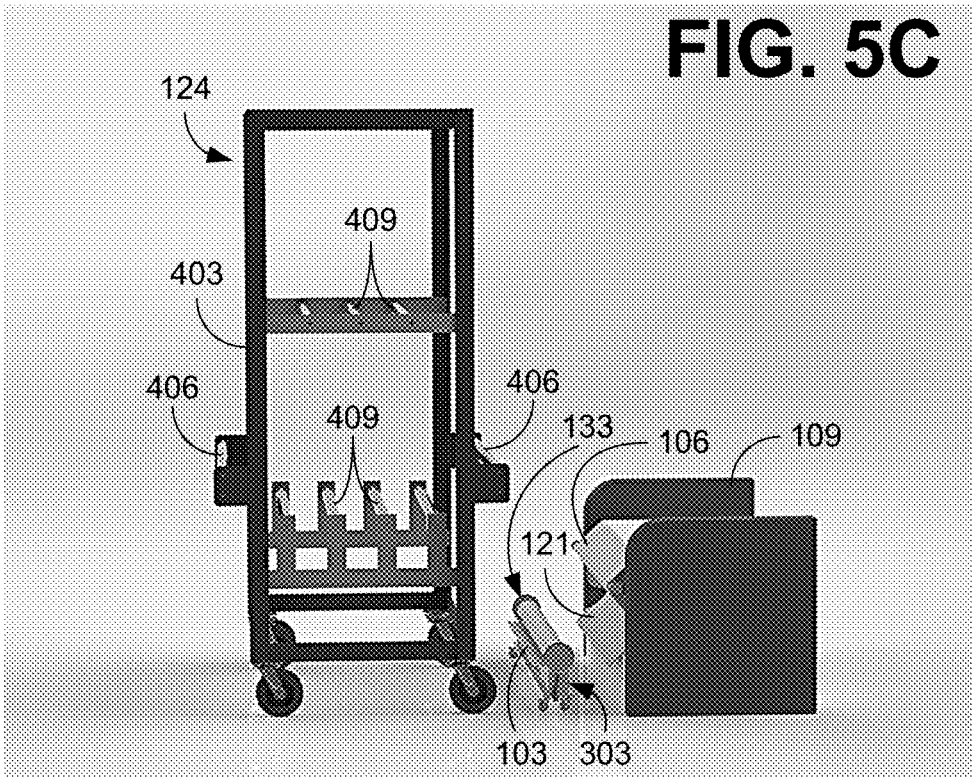

Referring next to FIGS. 5A-5K, shown another example of the non-stop tying in process using another embodiment of the warp accumulator 124 that allows for the accumulation of a longer warp sheet tail 121. In FIG. 5A, a warp sheet 106 is being supplied to a loom 109 from an installed warp beam 115. As the warp sheet 106 is unspooled from the warp beam 115, the free end of the warp sheet tail 121 is released from the warp beam 115 and becomes exposed as shown in FIG. 5B. As shown in FIG. 5C, a replacement warp beam 133 with a new warp sheet 103 and a warp accumulator 124 can be positioned adjacent to the loom 109 in preparation for the tying-in of the new warp sheet 103. The replacement warp beam 133 can be provided on a portable support system 303 to facilitate movement and positioning of the full warp beam 133 adjacent to the loom 109.

The warp accumulator 124 is a portable structure that allows it to be positioned next to the replacement warp beam 133, on the side opposite the loom 109 that accepts the new supply of warp. In the example shown in FIGS. 5C-5J, the warp accumulator 124 includes fixed rollers 406 on opposite sides of the frame 403, and movable rollers 409 that are configured to move to accumulate warp material as it is discharged from a warp beam 115. The movable rollers 409 can include a combination of moveable roller(s). In this example, two sets of movable rollers 409 are held in position by brackets extending across the ends of the movable rollers 409. The additional rollers and increased size allows the warp accumulator 124 to handle longer lengths of the warp sheet tails 121. The brackets allow the movable rollers to move vertically within the warp accumulator 124. In some implementations, one set of the rollers can be stationary and the other set can be movable.

Figure 5D:
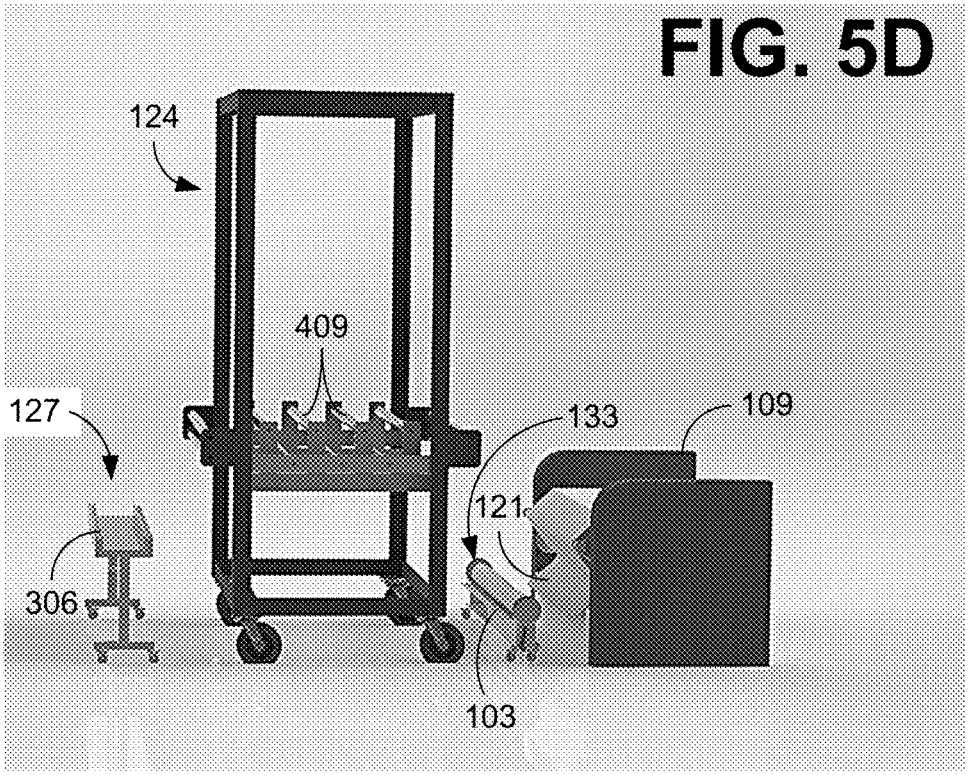

As shown in FIG. 5D, the lower brackets can include fingers that allow the lower movable rollers 409 to extend through the upper brackets and between the upper movable rollers 409 to facilitate threading of the warp sheet tail 121 through the rollers. In addition, the tying-in machine 127 can be positioned next to the warp accumulator 124, on the side opposite the replacement warp beam 133, as illustrated in FIG. 5D. The tying-in machine 127 can include a tying-in table 306, to which yarns of the warp sheets 103 and 106 are secured.

Figure 5E:
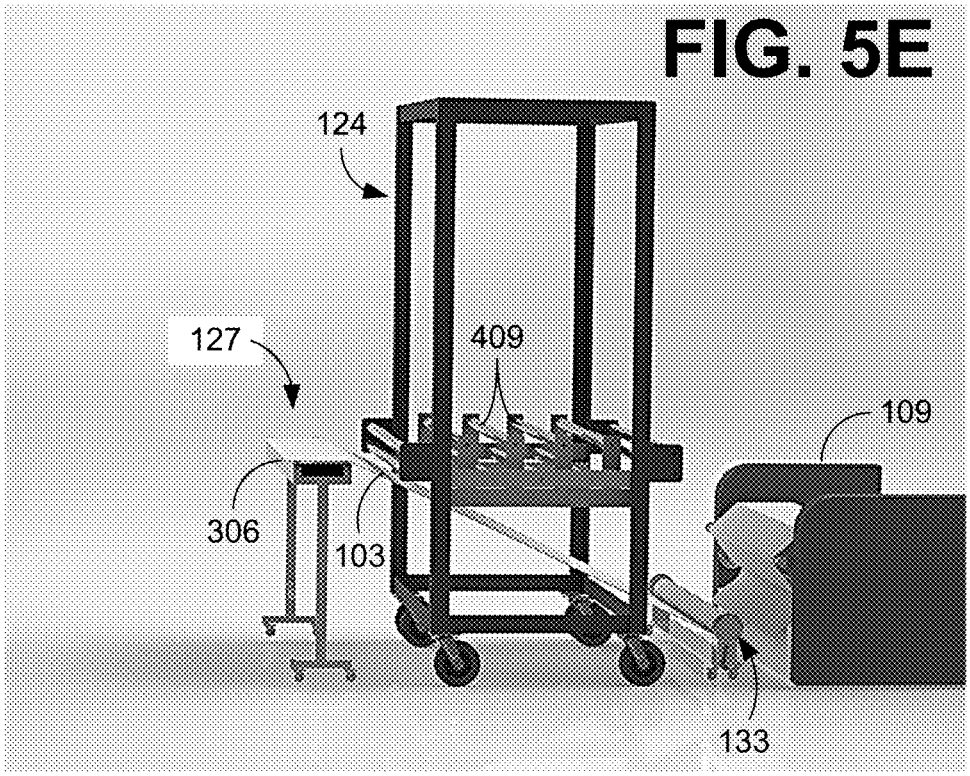
Figure 5F:
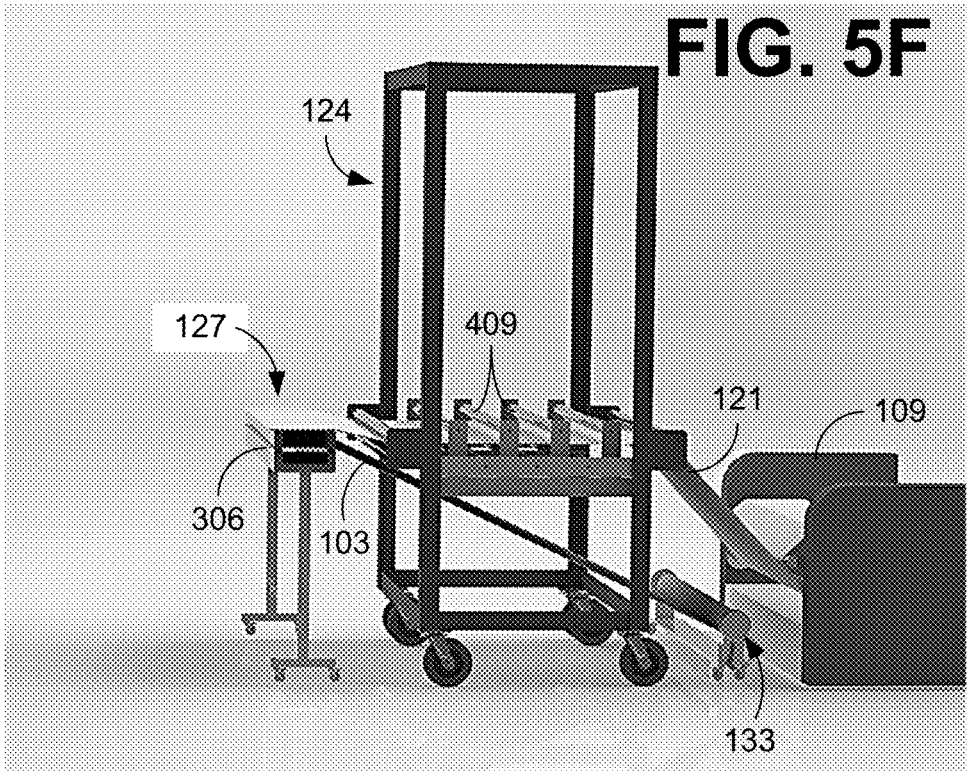
Figure 5G:
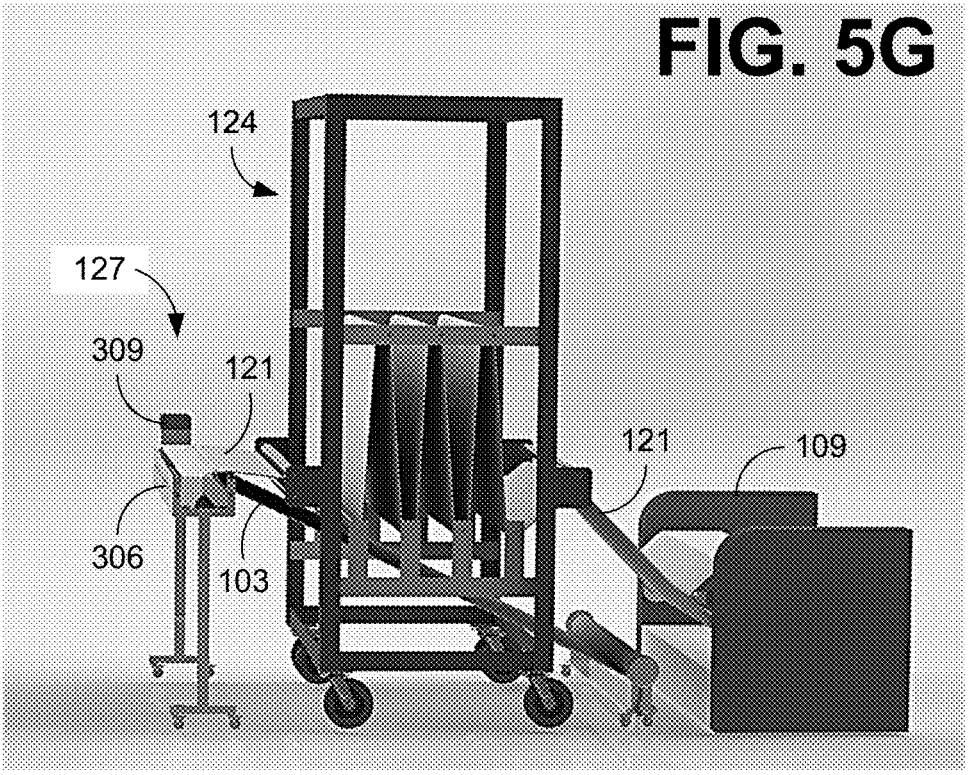

The free end of the new warp sheet 103 can be fed through the warp accumulator 124 and fixed to the tying-in table 306 as shown in FIG. 5E. As the warp sheet tail 121 is released from the warp beam 115 in the loom 109, the free end can be threaded through the rollers 406 and 409 of the warp accumulator 124 and fixed to the tying-in table 306 as shown in FIG. 5F. The tying-in head 309 of the tying-in machine 127 can then connect the yarns of the new warp sheet 103 to the corresponding ones of the warp sheet tail 121 as illustrated in FIG. 5G. As the warp tail 121 is released from the warp beam 115 during the tying-in of the yarns, the movable rollers 409 of the warp accumulator 124 are repositioned to absorb the excess warp tail 121 as shown in FIG. 5G.

Figure 5H:
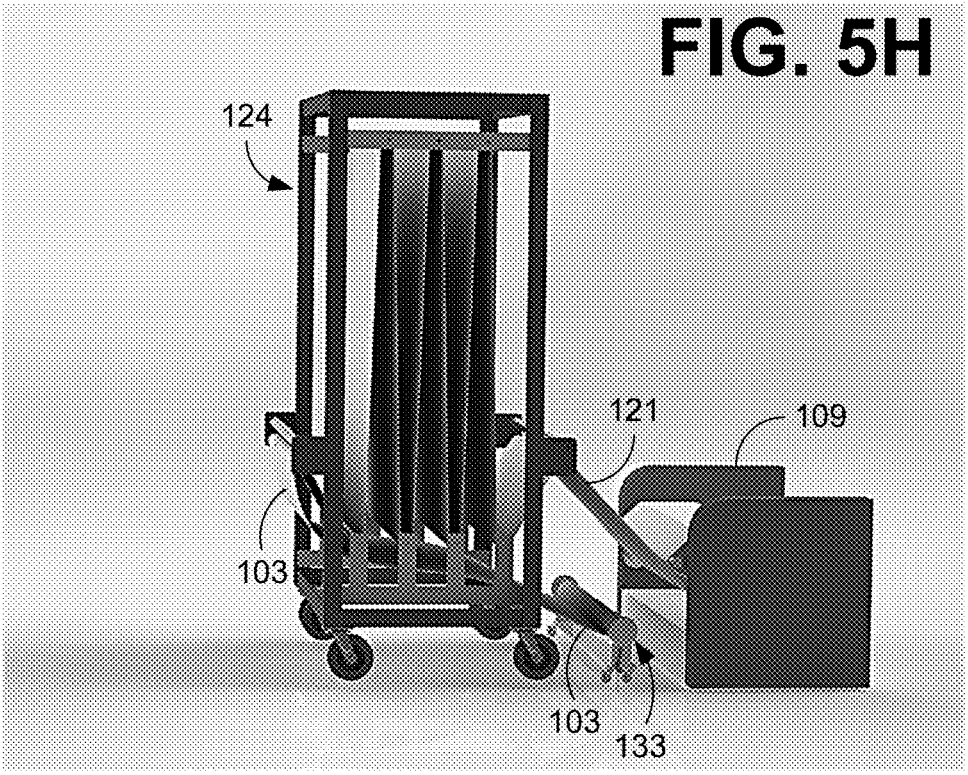
Figure 5I:
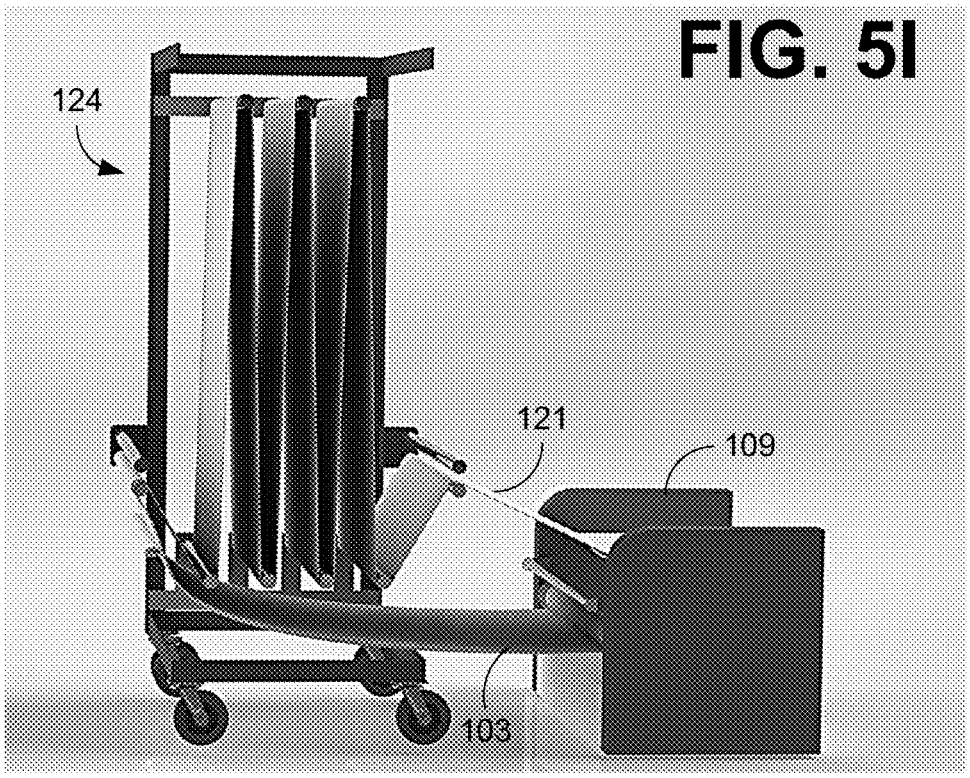
Figure 5J:
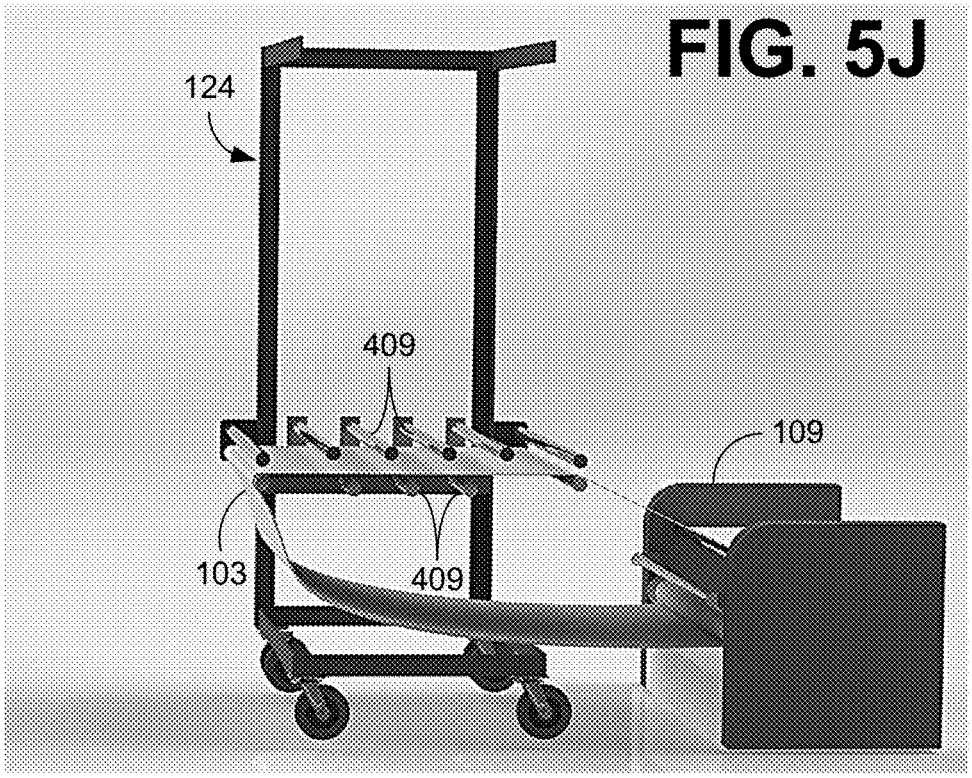
Figure 5K:
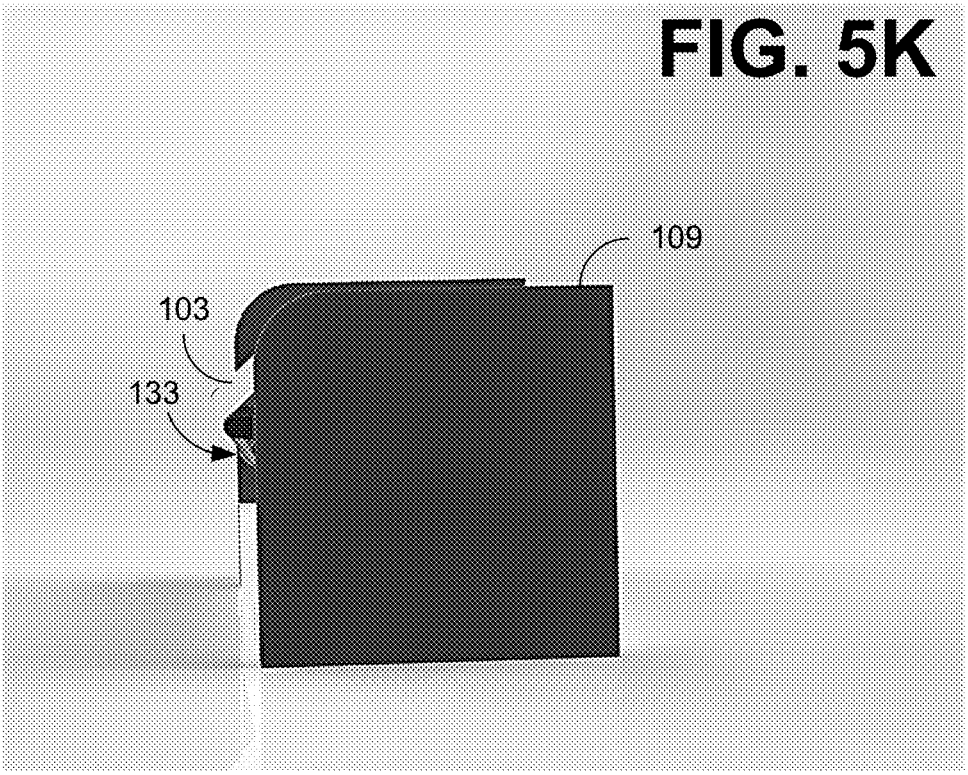

After the connection knots have been tied, trimmed and brushed, the new warp sheet 103 and warp sheet tail 121 can be released from the tying-in table 306 and the excess warp material can be accumulated and stored on the movable rollers 409 of the warp accumulator 124 as shown in FIG. 5H. The warp accumulator 124 continues to gather up the excess warp sheet tail 121 until it is released from the warp beam 115. At that point, the empty warp beam 115 can be replaced by the new warp beam 133 as the warp accumulator 124 releases the stored warp tail 121 to the loom 109. The warp accumulator 124 can then be removed to allow the warp sheet tail 121 and the new warp sheet 103 to feed the loom 109 without stopping the weaving process. As shown in FIG. 5I, the warp accumulator 124 can be split to allow the rollers to disengage from the warp sheet tail 121 and/or new warp sheet 103. As the warp tail 121 is used up as shown in FIG. 5J, and the warp accumulator 124 can be removed from the rollers. The new warp sheet 103 is then supplied to the loom 109 from the installed warp beam 133 without stopping as was illustrated in FIG. 5K. The loom 109 may be stopped for a short period of time for brushing the knots to separate them and when the new warp beam 133 is positioned in the loom 109.

While the warp accumulator 124 depicted in FIGS. 5A-5K comprises rollers 406 and 409 extending between two sides of the frame 403, other embodiments of the warp accumulator 124 can include rollers 406 and/or 409 that are supported by the frame 403 on only one end, in a cantilever fashion. In this case, the open end design allows the warp sheet tail 121 to be easily threaded through the rollers 406 and 409 of the warp accumulator 124 and the new warp sheet 103 and/or warp sheet tail 121 to be easily removed from the warp accumulator 124 after tying-in, without the need to split the warp accumulator 124. In various embodiments, the warp accumulator 124 can include rollers 406 and/or 409 that can slide horizontally out of the warp accumulator 124 to allow the new warp sheet 103 and warp sheet tail 121 to be released.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range. The term "about" can include traditional rounding according to significant figures of numerical values. In addition, the phrase "about 'x' to 'y'" includes "about 'x' to about 'y'".

Therefore, at least the following is claimed:

1. A method for non-stop tying-in of loom warps during operation of a loom, comprising:

providing a free end of a replacement warp sheet to a tying-in machine, the replacement warp sheet wound on a first warp beam;

providing a free end of a warp sheet tail of an existing warp sheet to the tying-in machine during the operation of the loom, wherein the free end of the warp sheet tail is unwound from a second warp beam in the loom and is provided from the second warp beam to the tying-in machine through a warp accumulator separate from the loom, and wherein the existing warp sheet is simultaneously unwound from the second warp beam and supplied to the loom during the operation while the free end of the warp sheet tail is unwound and provided to the tying-in machine;

accumulating the warp sheet tail in the warp accumulator as it is unwound from the second warp beam during tying-in of the free ends of the replacement warp sheet and the warp sheet tail by the tying-in machine;

supplying at least a portion of the warp sheet tail that was accumulated by the warp accumulator to the loom after the existing warp sheet and warp sheet tail are released from the second warp beam;

removing the tied-in warp sheet tail from the warp accumulator; and supplying the replacement warp sheet to the loom without stopping the operation of the loom.

2. The method of claim 1, wherein the replacement warp sheet extends from the first warp beam to the tying-in machine through the warp accumulator.

3. The method of claim 1, wherein the free ends of the replacement warp sheet and the warp sheet tail are secured to a tying-in table of the tying-in machine.

4. The method of claim 1, wherein the free end of the warp sheet tail is threaded through a first movable roller and a second roller of the warp accumulator to provide the free end to the tying-in machine, wherein the first movable roller is configured to move away from the second roller to accumulate the warp sheet tail in the warp accumulator.

5. The method of claim 4, wherein the second roller is a movable roller.

6. The method of claim 5, wherein the first and second movable rollers move vertically within guide brackets.

7. The method of claim 4, wherein the free end of the warp sheet tail is threaded through a first set of movable rollers comprising the first movable roller and a second set of movable rollers comprising the second roller to provide the free end to the tying-in machine, wherein the first and second sets of movable rollers are configured to move in opposite directions to accumulate the warp sheet tail in the warp accumulator.

8. The method of claim 1, comprising:

removing the second warp beam from the loom after the existing warp sheet and warp sheet tail are released from the second warp beam; and installing the first warp beam in the loom before removing the tied-in warp sheet tail from the warp accumulator.

9. The method of claim 1, comprising disassembling a portion of the warp accumulator to enable removing the tied-in warp sheet tail from the warp accumulator without stopping loom operation.

10. The method of claim 9, wherein one side of the warp accumulator is disconnected and separated from a remaining portion of the warp accumulator to remove the tied-in warp sheet tail from the warp accumulator.

11. The method of claim 10, wherein the remaining portion of the warp accumulator comprises rollers supporting the tied-in warp sheet tail.

12. A system for non-stop tying-in of loom warps during operation of a loom, comprising:

a warp accumulator configured to accumulate warp sheet material of a warp sheet tail of an existing warp sheet being supplied to the loom from an installed warp beam;

a replacement warp beam mounted on a portable support system, the replacement warp beam comprising a replacement warp sheet; and a tying-in machine configured to tie-in free ends of the replacement warp sheet and the warp sheet tail during accumulation of the warp sheet material by the warp accumulator.

13. The system of claim 12, wherein the free end of the replacement warp sheet is secured to a tying-in table of the tying-in machine after passing through the warp accumulator and the free end of the warp sheet tail is secured to the tying-in table after passing over a plurality of movable rollers of the warp accumulator.

14. The system of claim 12, wherein the warp accumulator comprises:

a frame; and a plurality of movable rollers configured to accumulate the warp sheet material in the warp accumulator, the plurality of movable rollers comprising a first movable roller and a second roller, the first movable roller configured to move away from the second roller to accumulate the warp sheet material, wherein individual movable rollers of the plurality of movable rollers extend from a proximal end attached to a side of the frame.

15. The system of claim 14, wherein the frame comprises roller guide brackets on sides of the frame, the roller guide brackets configured to independently constrain movement of an individual movable roller extending between the corresponding roller guide brackets.

16. The system of claim 15, wherein the movement of the plurality of movable rollers is constrained to vertical movement along the roller guide brackets.

17. The system of claim 14, wherein the plurality of movable rollers are repositionable in the frame and comprise a first set of movable rollers comprising the first movable roller and a second set of movable rollers comprising the second roller, wherein the warp sheet material is threaded between rollers of the first and second sets of movable rollers.

18. The system of claim 17, wherein the first set of movable rollers are configured to move in unison during accumulation of the warp sheet material.

19. The system of claim 18, wherein the second set of movable rollers are configured to move in unison during accumulation of the warp sheet material, wherein the first and second sets of movable rollers move in opposite directions during accumulation of the warp sheet material.

20. The system of claim 14, further comprising at least one fixed roller that extends from a proximal end attached to a second side of the frame to a distal end detachably attached to a first side of the frame.

* * * * *